US009121252B2

(12) United States Patent
George et al.

(10) Patent No.: US 9,121,252 B2
(45) Date of Patent: Sep. 1, 2015

(54) METHOD AND APPARATUS FOR ESTABLISHING INJECTION INTO A CASED BORE HOLE USING A TIME DELAY TOE INJECTION APPARATUS

(71) Applicant: GEODynamics, Inc., Millsap, TX (US)

(72) Inventors: Kevin R. George, Cleburne, TX (US); James A. Rollins, Lipan, TX (US); David S. Wesson, The Woodlands, TX (US)

(73) Assignee: GEODYNAMICS, INC., Millsap, TX (US)

( * ) Notice: Subject to any disclaimer, the term of this patent is extended or adjusted under 35 U.S.C. 154(b) by 101 days.

(21) Appl. No.: 14/012,089

(22) Filed: Aug. 28, 2013

(65) Prior Publication Data

US 2014/0251620 A1 Sep. 11, 2014

Related U.S. Application Data

(63) Continuation-in-part of application No. 13/788,068, filed on Mar. 7, 2013.

(51) Int. Cl.

| | |
|---|---|
| ***E21B 34/10*** | (2006.01) |
| ***E21B 34/06*** | (2006.01) |
| *E21B 34/00* | (2006.01) |

(52) U.S. Cl.

CPC ..... *E21B 34/108* (2013.01); *E21B 34/063* (2013.01); *E21B 2034/007* (2013.01)

(58) Field of Classification Search

CPC ..... E21B 34/063; E21B 34/06; E21B 34/08; E21B 2034/007; E21B 34/108; E21B 43/16; E21B 43/162

See application file for complete search history.

(56) References Cited

U.S. PATENT DOCUMENTS

| | | | | |
|---|---|---|---|---|
| 4,614,156 | A | 9/1986 | Colle et al. | |
| 5,062,485 | A | 11/1991 | Wesson et al. | |
| 5,078,210 | A | 1/1992 | George | |
| 5,209,303 | A | 5/1993 | Barrington | |
| 5,305,833 | A | 4/1994 | Collins | |
| 7,195,067 | B2 | 3/2007 | Manke et al. | |
| 7,849,925 | B2 * | 12/2010 | Patel | 166/334.4 |
| 7,913,603 | B2 | 3/2011 | LaGrange et al. | |
| 8,079,296 | B2 | 12/2011 | Barton et al. | |
| 8,267,178 | B1 | 9/2012 | Sommers et al. | |
| 2003/0221837 | A1 * | 12/2003 | Giroux et al. | 166/373 |
| 2010/0314562 | A1 * | 12/2010 | Bisset | 251/12 |
| 2012/0279723 | A1 | 11/2012 | Hofman et al. | |
| 2013/0025872 | A1 * | 1/2013 | Mailand et al. | 166/332.1 |
| 2013/0292133 | A1 * | 11/2013 | Thompson | 166/373 |

* cited by examiner

*Primary Examiner* — Yong-Suk (Philip) Ro

(74) *Attorney, Agent, or Firm* — David W. Carstens; Sudhakar V. Allada; Carstens & Cahoon, LLP

(57) ABSTRACT

An apparatus and method for providing a time delay in injection of pressured fluid into a geologic formation. In one aspect the invention is a toe valve activated by fluid pressure that opens ports after a predetermined time interval to allow fluid to pass from a well casing to a formation. The controlled time delay enables casing integrity testing before fluid is passed through the ports. This time delay also allows multiple valves to be used in the same well casing and provide a focused jetting action to better penetrate a concrete casing lining.

20 Claims, 8 Drawing Sheets

METHOD AND APPARATUS FOR ESTABLISHING INJECTION INTO A CASED BORE HOLE USING A TIME DELAY TOE INJECTION APPARATUS

CROSS-REFERENCE TO RELATED APPLICATION

This application is a Continuation-In-Part of and claims the benefit and priority from U.S. application Ser. No. 13/788,068, filed Mar. 7, 2013, the contents and disclosure of which is incorporated herein by reference for all purposes.

BACKGROUND

1. Field

An apparatus and method for providing a time delay in injection of pressured fluid into a geologic formation. More specifically, it is a toe valve apparatus activated by fluid pressure that opens ports after a predetermined time interval to allow fluid to pass from a well casing to a formation.

2. Background

It has become a common practice to install a pressure responsive opening device at the bottom or toe of a casing string within horizontal well bores and in some vertical bores. These devices make up and run as an integral part of the casing string. After the casing has been cemented and allowed to solidify, the applied surface pressure is combined with the hydrostatic pressure and a pressure responsive valve is opened. The combination of hydrostatic and applied pressure is customarily used to overcome a number of shear pins or to overcome a precision rupture disc. Once communication with the well bore [i.e., area outside of the casing] is achieved, the well can be hydraulically fractured or the valve can be used as an injection port to pump down additional wire line perforating guns, plugs or other conveyance means such as well tractors. Other known methods of establishing communication with the cemented and cased well include tubing conveyed or coil tubing conveyed perforators. These are all common methods to achieve an injection point but require increased time and money.

The present invention provides an improved m apparatus and method that provides a time delay in fluid injection through the casing.

SUMMARY

This invention is an apparatus that allows a time delay in the injection of fluid through a section of oil and/or gas well casing to perforate a geologic formation (hydrofracturing). It does so by providing a sliding sleeve that uncovers ports in the apparatus in a time controlled manner. Controlled opening of the ports by a sliding sleeve also result in a jetting action that improves perforation of the formation. It is, in broad aspect, an apparatus and method to provide time-delayed injection of pressurized fluid from a well casing to a geological formation, the apparatus comprising:

a housing with port openings that can communicate through the walls of the housing to a formation;

a movable piston or pistons capable of covering and uncovering the opening(s);

means for moving the piston to position leaving the opening(s) uncovered; and means for activation of the movement of the piston.

The invention is also a method, in broad aspect, it is the use and activation of the apparatus as described.

DETAILED DESCRIPTION OF DRAWINGS

Figure 1A:
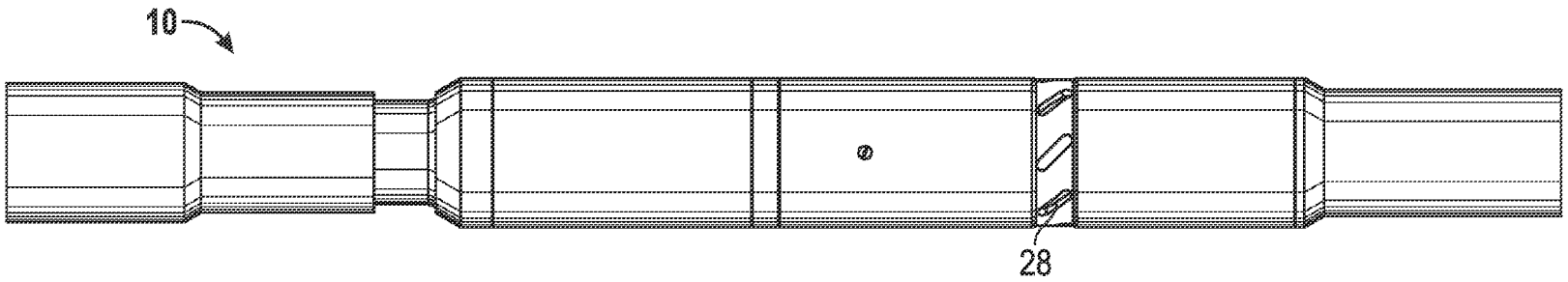
FIG. 1*a* is a plan view of an apparatus of an embodiment of the invention.

The present invention is an improved "toe valve" apparatus and method to allow fluid to be pressured through ports in an oil or gas well casing wall section (and casing cement) into a geologic formation in a time delayed manner.

The apparatus, in broad aspect, provides time-delayed injection of pressurized fluid through openings in a well casing section to a geological formation comprising:

a housing with openings that can communicate through ports in the walls of the apparatus housing to a formation;

a movable piston or pistons capable of moving into position to provide covering and sealing the port(s) and to a position where the ports are uncovered;

means for moving the piston to a final position leaving the port(s) uncovered; and means for activation the movement of the piston.

The present invention represents several improvements over conventional pressure responsive devices—improvements that will be appreciated by those of ordinary skills in the art of well completions. The greatest limitation of current devices is that the sleeve or power piston of the device that allows fluid to flow from the casing to a formation (through openings or ports in the apparatus wall) opens immediately after the actuation pressure is reached. This limits the test time at pressure and in many situations precludes the operator from ever reaching the desired casing test pressure. The present invention overcomes that limitation by providing a hydraulic delay to afford adequate time to test the casing at the required pressure and duration before allowing fluid communication with the well bore and geologic formation. This is accomplished by slowly releasing a trapped volume of fluid through a hydraulic metering chamber that allows a piston covering the ports to move to a position where the ports are uncovered. This feature will become even more advantageous as federal and state regulators mandate the duration or dwell time of the casing test pressure. The metering time can be increased or tailored to a specific test requirement through manipulation of the fluid type, fluid volume, by altering the flow rate of the hydraulic liquid flow restrictor and by appropriate placement and setting of pressure valves on either or both sides of the flow restrictor.

A second advantage of this invention is that two or more valves can be installed (run) as part of the same casing installation. This optional configuration of running two or more valves is made possible by the delay time that allows all of the valves to start metering before any of the valves are opened. The feature and option to run two or more valves in a single casing string increases the likelihood that the first stage of the well can be fracture stimulated without any well intervention whatsoever. Other known devices do not allow more than a single valve to operate in the same well since no further actuation pressure can be applied or increased after the first valve is opened.

A third significant advantage is that in the operation of the valve, the ports are opened slowly so that as the ports are opened (uncovered) the liquid is injected to the cement on the outside of the casing in a high pressure jet (resulting from the initial small opening of the ports), thus establishing better connection to the formation. As the ports are uncovered the fluid first jets as a highly effective pinpoint cutting jet and enlarges as the ports are opened to produce an effect of a guide-hole that is then enlarged.

Figure 1B:
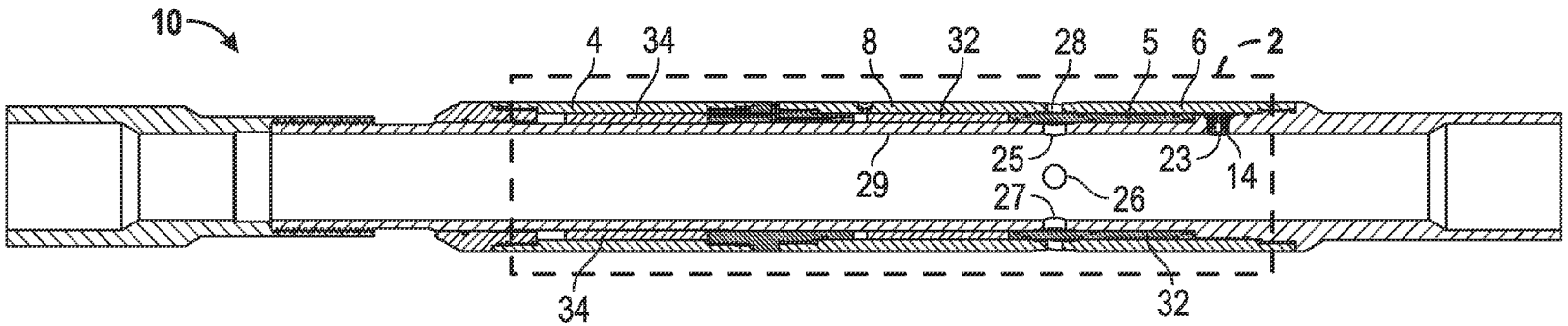
FIG. 1*b* is a plan view of a cross section of an apparatus of an embodiment of the invention.

Referring to the Figures, FIG. 1A represents an inner mandrel, 10, that is inserted directly into the casing string and shows an overall external view of an embodiment of the apparatus of the invention. Item 28 represents slotted ports through which fluid will be transported into the geologic formation surrounding the casing. FIG. 1B shows a cross section view of the apparatus of FIG. 1A. The integral one-piece design of the mandrel carries all of the tensile, compressional and torsional loads encountered by the apparatus. The entire toe valve apparatus is piped into the casing string as an integral part of the string and positioned where perforation of the formation and fluid injection into a formation is desired. The apparatus may be installed in either direction with no change in its function.

Figure 2:
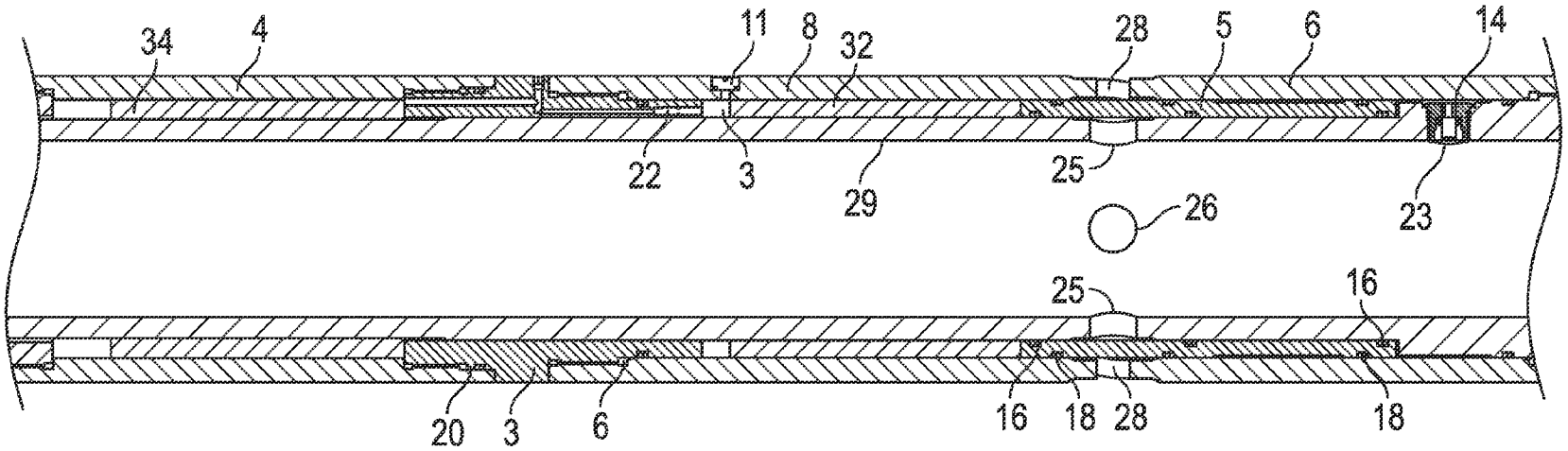
FIG. 2 is an exploded section view of the apparatus displayed in FIGS. 1*a* and 1*b* in which the ports are closed.

FIG. 2 (a section of FIG. 1B) shows an exploded view of details of the apparatus of an embodiment of the invention. Item 23 is a pressure activated opening device (preferably a Reverse Acting Disc but conventional rupture discs may be used). Since the rupture disc is in place in the casing string during cementing it is very advantageous to have a reverse acting rupture disc that will not be easily clogged and not require extra cleaning effort. The valve mandrel is machined to accept the opening device item 23 (such as rupture discs) that ultimately controls actuation of the piston, 5. The opening piston, 5, is sealed by elastomeric seals (16, 18 and 20 in FIGS. 2 and 45, 47 and 49 in FIG. 6)) to cover the inner and outer ports, 25-27 and 28, in the apparatus.

Figure 3:
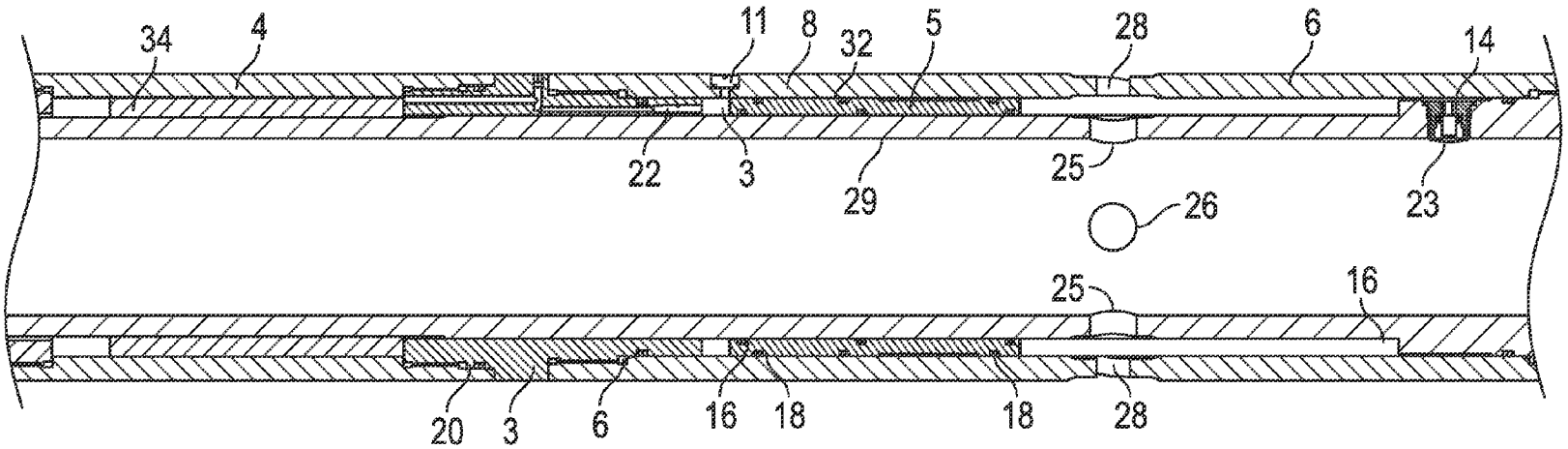
FIG. 3 is an exploded section view of the apparatus displayed in FIGS. 1*a* and 1*b* in which the ports are open.
Figure 4:
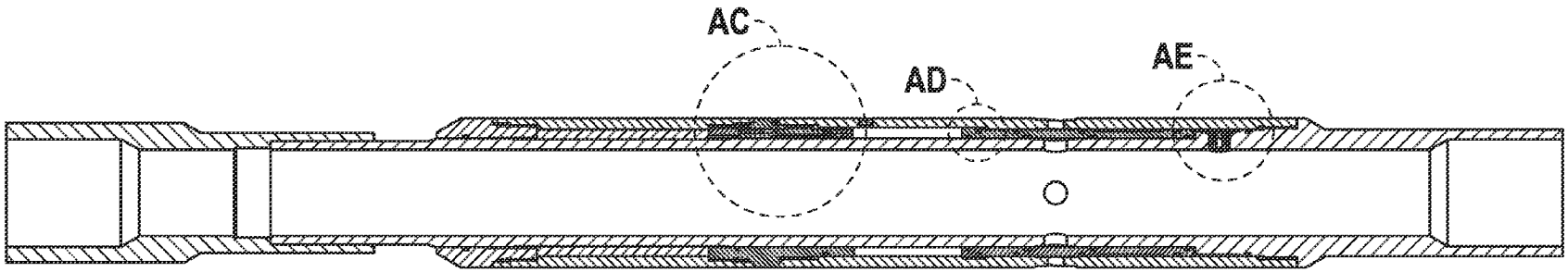
FIG. 4 is a plan view of an apparatus of an embodiment of the invention.
Figure 5:
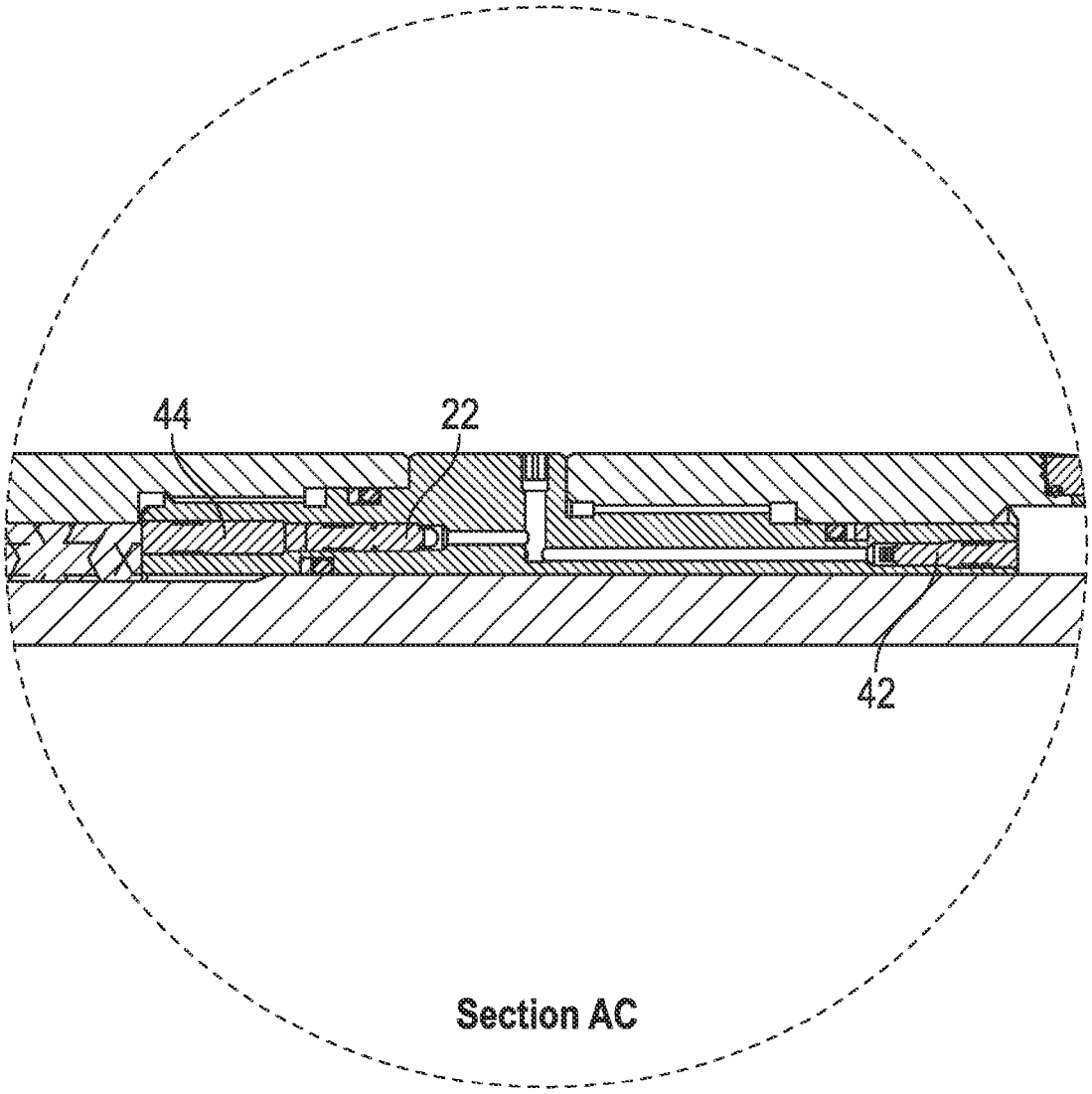
FIG. 5 is an exploded section view AE of a section of the apparatus of an embodiment of the invention displayed in FIG. 4.
Figure 7:
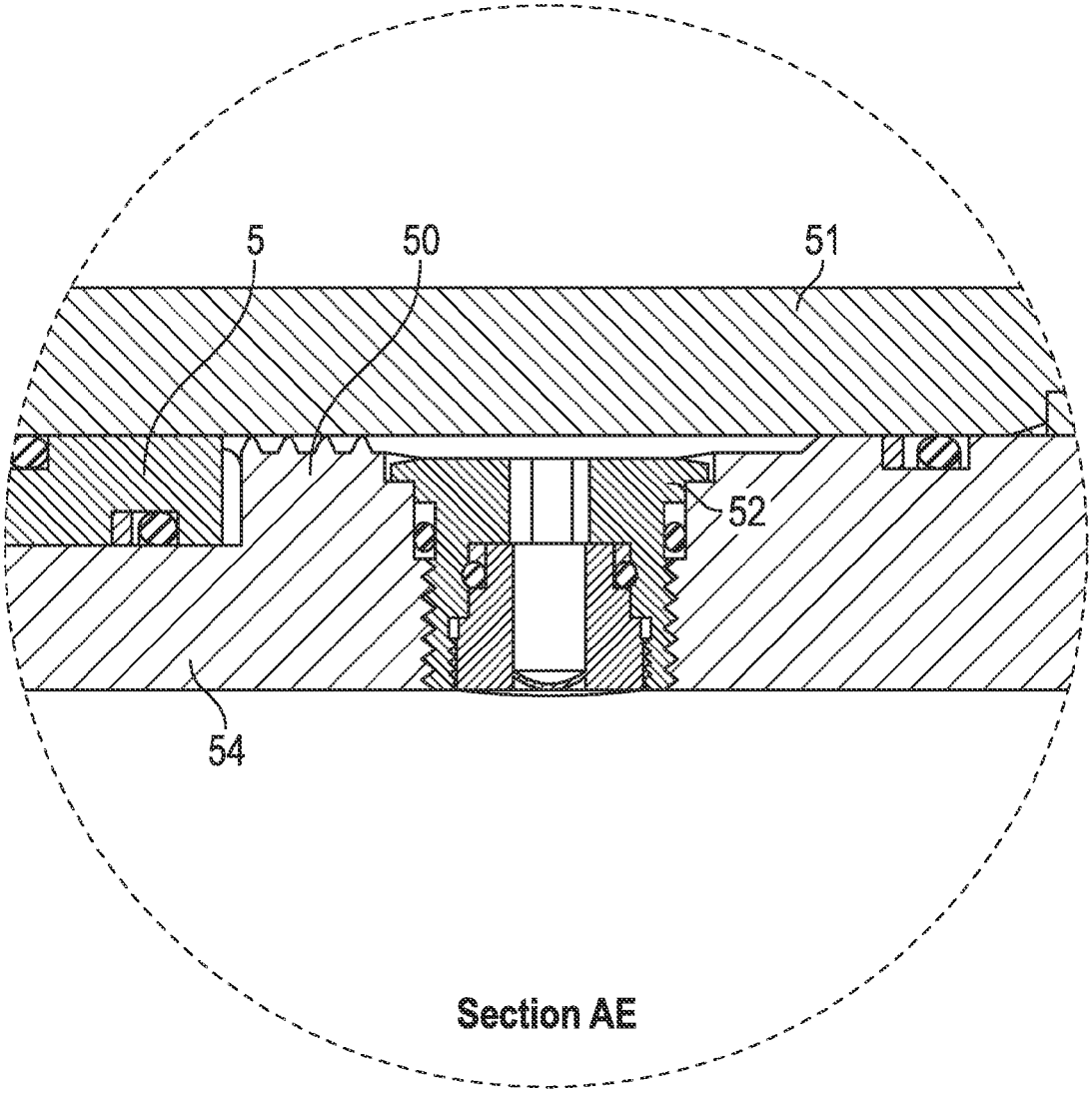
FIG. 7 is an exploded section view AD of a section of an embodiment of the invention the apparatus displayed in FIG. 4

The openings 25-27 (and a forth port not shown) shown in FIGS. 2 and 3 are open ports. In one embodiment the ports 25-27 (and other inside ports) will have means to restrict the rate of flow such as baffles (50 in FIG. 5) as, for example, with a baffle plate consisting of restrictive ports or a threaded and tortuous pathway, 50. This will impede rapid influx of well bore fluids through the rupture discs, 23 in FIGS. 2 and 52 in FIG. 7 into the piston chamber 32. In FIG. 5, item 54 is the mandrel housing corresponding to item 5 in FIGS. 2 and 52 is the rupture disc that corresponds to 23 in FIG. 2. Item 51 is the mandrel housing and is the same as item 6.

Figure 6:
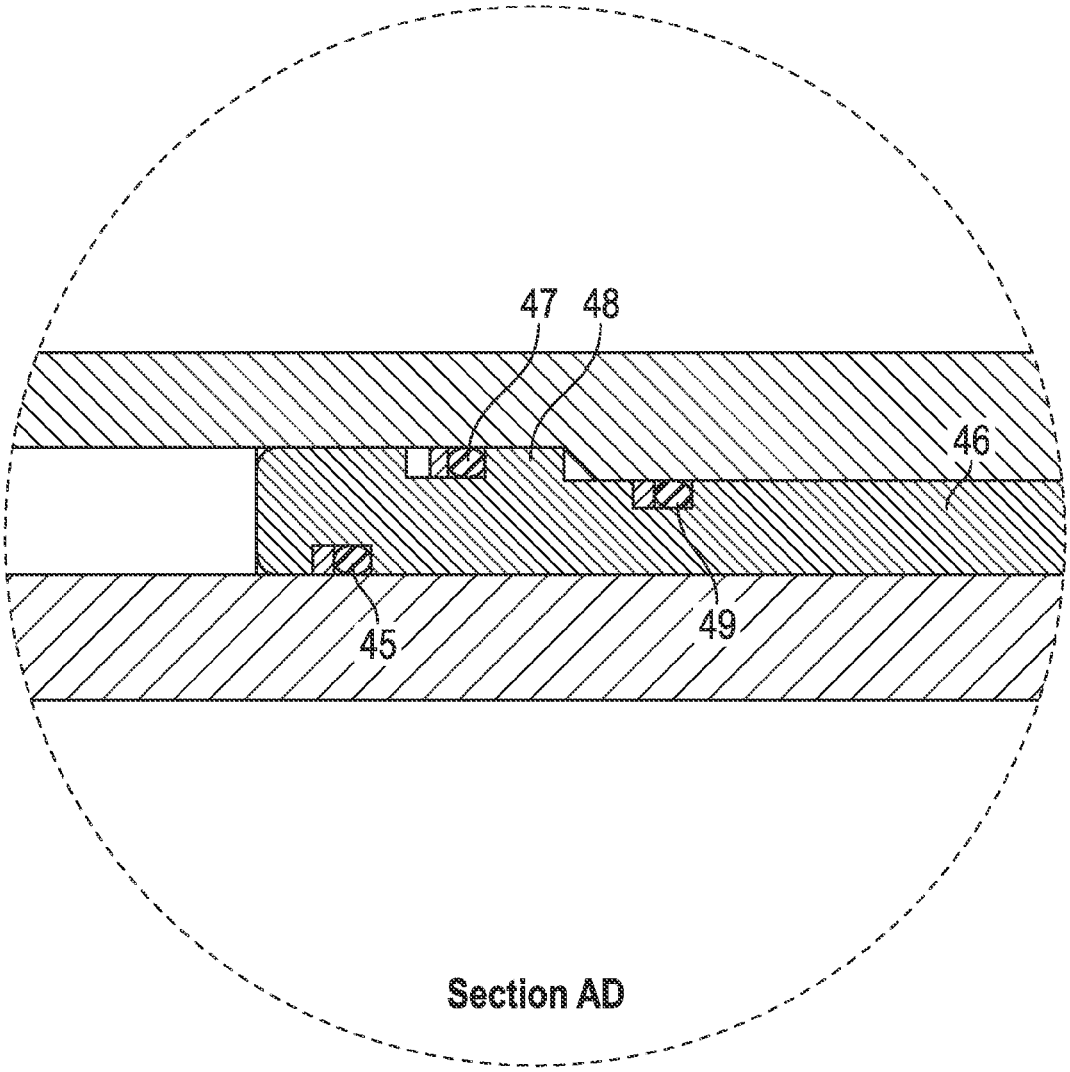
FIG. 6 is an exploded section view AC of a section of displayed in FIG. 4

In one embodiment, the piston, 5, has dual diameters (FIG. 6 shows the piston, 5 (46 and 48), with one section, 46, having a smaller diameter at one end than at the other end, 48. This stepped diameter piston design will reduce the internal pressure required to balance out the pressure across the piston when the piston is subjected to casing pressure. This pressure reduction will increase the total delay time afforded by a specific restrictor. The resistance to flow of a particular restrictor is affected by the differential pressure across the component. By reducing the differential across the component, the rate of flow can be skillfully and predictably manipulated. This design provides increased delay and pressure test intervals without adding a larger fluid chamber to the apparatus. The dual diameter piston allows the pressure in the fluid chamber to be lowered. This has several advantages; in particular the delay time will be increased by virtue of the fact that the differential pressure across a given restrictor or metering device will be reduced. With a balanced piston area, the pressure in the fluid chamber will be at or near the well bore pressure. With the lower end of the piston 46 smaller and the piston area adjacent to the fluid chamber, 48, larger the forces will balance with a lower pressure in the fluid chamber. In this way it will be easy to reduce the fluid chamber pressure by 25% or more.

A series of outer sections 4, 6, and 8 FIGS. 1A, 1B and 2) are threadedly connected to form the fluid and pressure chambers for the apparatus. The tandem, 3, not only couples item 4 and 5 but also houses a hydraulic restrictor 22. The area, 32, to the left of the piston, 5, is a fluid chamber and the area to the left of item 3 is the low pressure chamber that accommodates the fluid volume as it traverses across the hydraulic restrictor. The chambers are both capped by the item 8 upper cap.

The rupture disc 23 (52) is the activation device that sets the valve opening operation into play. When ready to operate (i.e., open the piston), the casing pressure is increased to a test pressure condition. This increased pressure ruptures the rupture disc 23 (52) and fluid at casing pressure (hydrostatic, applied or any combination) enters the chamber immediately below and adjacent to the piston 5 (in FIG. 2 this is shown at the right end of piston 5 and to the left of valve 14). This entry of fluid causes the piston 5 to begin moving (to the left in the drawings). This fluid movement allows the piston to move inexorably closer to an open position. In actual lab and field tests a piston movement of about 4.5 inches begins to uncover the inter openings 25-27 and the outer openings 28. These openings are initially closed or sealed off from the casing fluid by the piston 5. As piston 5 moves toward the open and final position, the slots, 28, are uncovered allowing fluid to flow through openings 25, 26 and 27 through slots 28. Thus, the restrained movement of the piston allows a time delay from the time the disc, 23 (52) is ruptured until the slots uncovered for fluid to pass. This movement continues until the piston has moved to a position where the ports are fully opened. Piston 5 surrounds the inter wall of the apparatus 29. As fluid pressure increases through port 14 it moves piston 5 into the fluid chamber 32. Hydraulic fluid in the fluid chamber restrains the movement of the piston. There is a hydraulic flow restrictor 22 that allows fluid to pass from chamber 32 to lower pressure chamber 34. This flow restrictor controls the rate of flow of fluid from chamber 32 to chamber 34 and thereby controls the speed of the movement of the piston as it moves to the full open position. Items 28 are the slots in the apparatus mandrel that will be the passageway for fluid from the casing to the formation. FIG. 3 shows the position of piston 5 when "opened" (moved into chamber 32). Initially, this movement increases pressure in the fluid chamber to a value that closely reflects the hydrostatic plus applied casing pressure. There is considerable predetermined control over the delay time by learned manipulation of the fluid type, fluid volume, initial charging pressure of the low pressure chamber and the variable flow rate through the hydraulic restrictor. The time delay can be set as desired but generally will be about 5 to 60 minutes. Any hydraulic fluid will be suitable if capable of withstanding the pressure and temperature conditions that exist in the well bore. Those skilled in the art will easily be able to select suitable fluids such as Skydrol 500B-4™.

In another embodiment there are added controls on the flow of fluid from the piston chamber 32 to the low pressure piston chamber 34 to more precisely regulate the speed at which the piston moves to open the ports. As illustrated in FIG. 5 (a sectional enlarged view of the section of the tool housing the flow restrictor that allows fluid to flow from the piston chamber 32 to the lower pressure chamber 34) there is a Back Pressure Valve or Pressure Relief Valve 42 placed downstream of the Flow Metering Section 22 to maintain a predetermined pressure in the Fluid Chamber. This improves tool reliability by reducing the differential pressure that exists between the Fluid Chamber 34 and the well bore pressure in the piston chamber 32. This Back Pressure Valve or Pressure Relief Valve 42 may be selected based on the anticipated hydrostatic pressure. Back pressure valve(s) may also be placed in series to increase the trapped pressure. Another Back Pressure Valve or Pressure Relief Valve 44 may be placed downstream of the Fluid Metering Section 22 to ensure that only a minimum fluid volume can migrate from the Fluid Metering Section 22 to the Low Pressure Chamber 34 during transport, when deployed in a horizontal well bore or when inverted for an extended period of time. By selecting the appropriate pressure setting of these back pressure valves "slamming" (forceful opening by sudden onrush of pressurized fluid) of the flow control valve is reduced.

In operation an apparatus of the invention will be piped into a casing string at a location that will allow fluid injection into the formation where desired. The apparatus may be inserted into the string an either direction. An advantage of the present invention is that two or more of the valves of the invention may be used in the string. They will, as explained above, open to allow injection of fluid at multiple locations in the formation. It can also be appreciated by those skilled in the art how two or more of valves of the invention may be used and programmed at different time delays to open during different stages of well operations as desired (e.g. one or more at 5 minute delay and one or more at 20 minutes delay). For example, the apparatus may be configured so that an operator may open one or more valves (activating the sliding closure) after a five minute delay, fracture the zone at the point of the open valves, then have one or more valves and continue to fractures the zone.

In general the apparatus will be constructed of steel having properties similar to the well casing.

A prototype apparatus had the general dimensions of about 60 inches in length, with a nominal outside diameter of 6.5 inches and an inside diameter of 3.75 inches. Other dimensions as appropriate for the well and operation in which the apparatus is intended to be used are intended to be included in the invention and may easily be determined by those of ordinary skill in the art.

Figure 8:
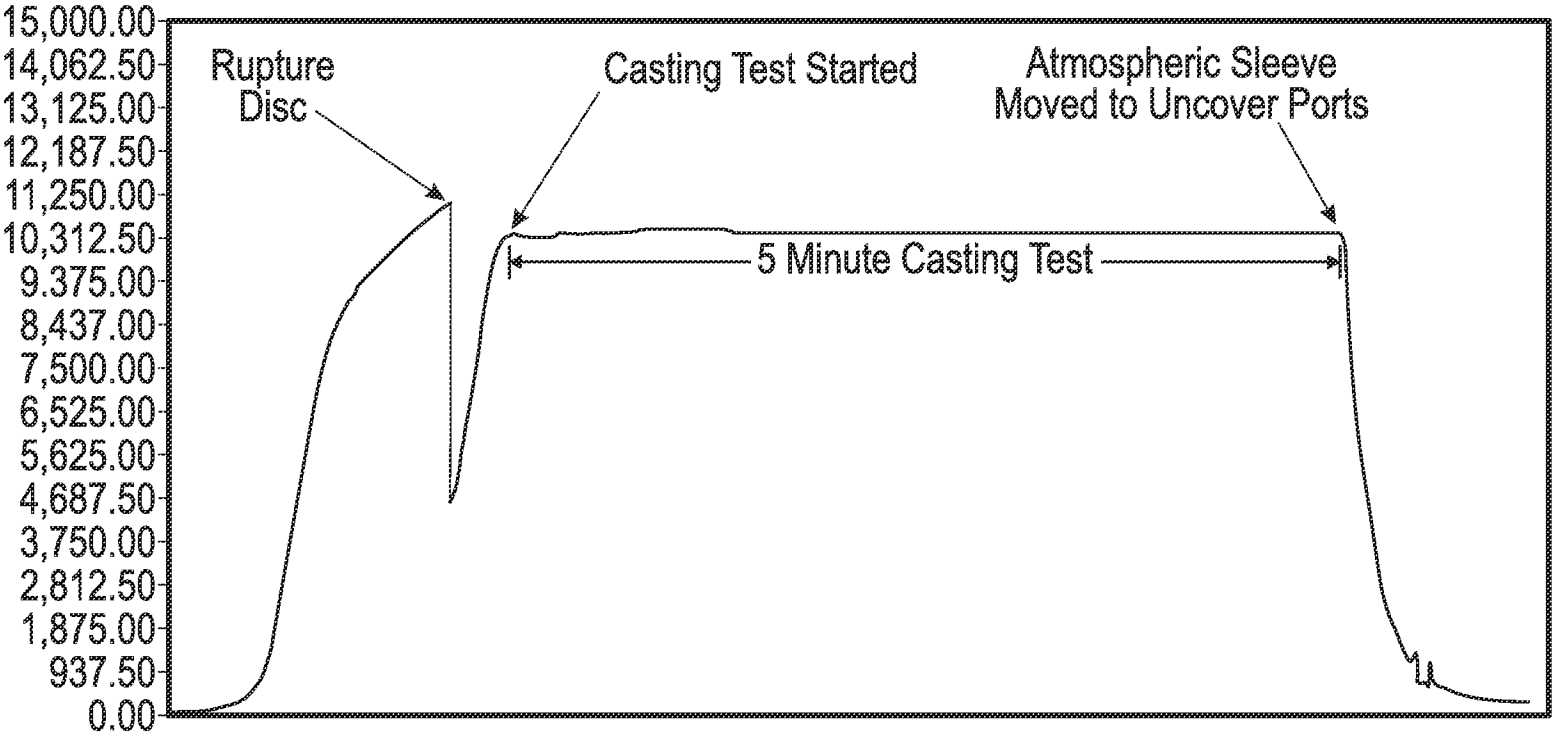
FIG. 8 is a graphic representation of results of a test of the operation of an apparatus of an embodiment of the invention.

FIG. 8 represents the results of a test of a prototype of the apparatus. As shown, a 5 minute test shows constant pressure for 5 minutes while the piston movement uncovered openings in the apparatus.

In the foregoing specification, the invention has been described with reference to specific embodiments thereof. It will, however, be evident that various modifications and changes can be made thereto without departing from the broader spirit and scope of the invention as set forth in the appended claims. The specification is, accordingly, to be regarded in an illustrative rather than a restrictive sense. Therefore, the scope of the invention should be limited only by the appended claims.

The invention claimed is:

1. An apparatus to provide time-delayed injection of pressurized fluid from a well casing into a geological formation comprising:

a housing with openings that allows fluid to pass through the openings to the formation;

a piston configured to cover the openings in a closed position;

a pressure activated opening device configured to be in pressure communication with the piston;

a restrictive means configured to be connected to the pressure activated opening device;

means for moving the piston to an open position leaving the openings uncovered; whereby, as a pressure of the pressurized fluid activates the pressure activated opening device, the restrictive means substantially impedes a flow of the pressurized fluid that moves the piston, and as the piston moves from the closed position into a high pressure chamber comprising a hydraulic fluid, the piston is restrained in movement by a passage of the hydraulic fluid from the high pressure chamber into a low pressure chamber through a liquid flow restrictor, and the movement of the piston from the closed position to the open position is delayed by a predetermined metering time.

2. The apparatus of claim 1 wherein the restrictive means is a threaded pathway.

3. The apparatus of claim 1 wherein the restrictive means is a tortuous pathway.

4. The apparatus of claim 1 wherein the restrictive means is a baffle plate comprising restrictive ports.

5. The apparatus of claim 1 wherein the pressure activated opening device is a rupture disk.

6. The apparatus of claim 1 wherein the pressure activated opening device is a reverse acting rupture disk.

7. The apparatus of claim 1 wherein the apparatus is integral to the well casing.

8. An apparatus to provide time-delayed injection of pressurized fluid from a well casing into a geological formation comprising:

a housing with openings that allows fluid to pass through the openings to the formation;

a piston configured to cover the openings in a closed position;

a pressure activated opening device configured to be in pressure communication with the piston; and means for moving the piston to an open position leaving the openings uncovered; wherein, the piston is configured with a first end and a second end; the first end is associated with a first diameter; the second end is associated with a second diameter; the first end is in pressure communication with a high pressure chamber; the first diameter is greater than the second diameter; whereby, as the piston is activated, the first end of the piston moves from the closed position into a high pressure chamber comprising a hydraulic fluid, the piston is restrained in movement by a passage of the hydraulic fluid from the high pressure chamber into a low pressure chamber through a liquid flow restrictor, and the movement of the piston from the closed position to the open position is delayed by a predetermined metering time.

9. The apparatus of claim 8 wherein the predetermined metering time delay is substantially increased without increasing the high pressure chamber area to the apparatus.

10. The apparatus of claim 8 wherein the first diameter is configured to allow a pressure in the high pressure chamber to be lowered, whereby the predetermined metering time delay is substantially increased.

11. The apparatus of claim 8 wherein the predetermined metering time is increased by reducing the differential pressure across the given restrictor.

12. The apparatus of claim 8 wherein the first diameter and the second diameter are chosen such that the pressure in the high pressure chamber pressure is reduced by at least 25%.

13. The apparatus of claim 8 wherein the apparatus is integral to the well casing.

14. An apparatus to provide time-delayed injection of pressurized fluid from a well casing into a geological formation comprising:

a) a housing with openings that allows fluid to pass through the openings to the formation;

b) a piston configured to cover the openings in a first closed position;

c) a pressure activated opening device configured to be in pressure communication with the piston;

d) a restriction valve configured to be in pressure communication with a liquid flow restrictor; and e) means for moving the piston to a second open position leaving the openings uncovered;

whereby, when the piston moves from the first closed position into a high pressure chamber comprising a hydraulic fluid, the piston is restrained in movement by a passage of the hydraulic fluid from the high pressure chamber into a low pressure chamber through the liquid flow restrictor and the restriction valve and, the movement of the piston from the first closed position to the second open position is delayed by a predetermined metering time.

15. The apparatus of claim 14 wherein the restriction valve reduces a differential pressure across the hydraulic flow restrictor.

16. The apparatus of claim 14 wherein the restriction valve is a back pressure valve.

17. The apparatus of claim 16 further comprises a second back pressure valve connected in series with the back pressure valve.

18. The apparatus of claim 14 wherein the movement of the piston is further restrained by the restriction valve.

19. The apparatus of claim 14 wherein further comprises a second restriction valve connected downstream to the hydraulic flow restrictor.

20. The apparatus of claim 14 wherein the apparatus is integral to the well casing.

* * * * *